US006431369B1

(12) United States Patent
Boller et al.

(10) Patent No.: US 6,431,369 B1
(45) Date of Patent: Aug. 13, 2002

(54) DEVICE FOR SORTING AND SELECTIVELY COLLECTING FLAT PRODUCTS

(75) Inventors: Manfred Boller, Hohentengen (DE); Jean-Claude Oppliger, Niederhasli (CH)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 09/528,312

(22) Filed: Mar. 17, 2000

(30) Foreign Application Priority Data

Mar. 22, 1999 (EP) ..... 99810251

(51) Int. Cl.[7] ..... B07C 5/36

(52) U.S. Cl. ..... 209/615; 209/651; 209/900; 209/917

(58) Field of Search ..... 209/615, 616, 209/651, 584, 900, 917; 271/184, 198, 300, 306, 307, 308

(56) References Cited

U.S. PATENT DOCUMENTS 4,895,242 A * 1/1990 Michel ..... 209/900 X

FOREIGN PATENT DOCUMENTS

| | | | | |
|---|---|---|---|---|
| EP | 424789 | * | 5/1991 | ..... 209/900 |
| EP | 0638501 | | 2/1995 | |
| EP | 0640409 | | 3/1995 | |
| EP | 0899026 | | 3/1999 | |
| EP | 0949166 | | 10/1999 | |

* cited by examiner

*Primary Examiner*—Tuan N. Nguyen
(74) *Attorney, Agent, or Firm*—Friedrich Kueffner

(57) ABSTRACT

A device for sorting and selectively collecting flat products, such as shipping pouches, printed products or workpieces, which are placed at predetermined collecting points along the conveying path of an endless conveyor and below the conveyor in collecting containers, includes a pushing device for moving the empty collecting containers transversely of the direction of movement of the conveyor on a transfer path between a lateral pick-up position and the collecting point. The pushing device is reversibly driven in a guide arrangement of the transfer path, wherein the filled collecting containers can be ejected from the collecting point. For driving the pushing device, the pushing device is connected to a drive member of a fixedly mounted drive unit, wherein the drive member is attached to an endless or revolving traction unit.

18 Claims, 4 Drawing Sheets

DEVICE FOR SORTING AND SELECTIVELY COLLECTING FLAT PRODUCTS

BACKGROUND OF THE INVENTION

1. Field of the Invention

The present invention relates to a device for sorting and selectively collecting flat products, such as shipping pouches, printed products or workpieces, which are placed at predetermined collecting points along the conveying path of an endless conveyor and below the conveyor in collecting containers, wherein the empty collecting containers can be moved transversely of the direction of movement of the conveyor on a transfer path between a lateral pick-up position and the collecting point by a pushing device which is reversibly driven in a guide arrangement of the transfer path, and wherein the filled collecting containers can be ejected from the collecting point.

2. Description of the Related Art

A device of the above-described type, as disclosed in EP-A-0 899 026, is used for sorting flat products, such as shipping pouches, printed products or workpieces, which have been individually supplied by conveyors and which are placed on the conveying path in collecting conveyors along the conveying path at several collecting points or filling stations provided underneath the conveyor.

If feeding of the empty collecting conveyors to the pushing device is to take place automatically, for example, as described in European patent application no. 98810308, the drive of the pushing device is to be constructed accordingly.

SUMMARY OF THE INVENTION

Therefore, it is the primary object of the present invention to construct the pushing device in such a way that it permits an automatic feeding with empty collecting containers in a simple manner.

In accordance with the present invention, the pushing device is connected for driving the pushing device to a drive member of a fixedly mounted drive unit, wherein the drive member is attached to an endless traction means.

The configuration according to the present invention makes it possible to provide a simple construction of the pushing device which is capable of precisely moving into the required positions, is low in wear and easy to maintain.

In accordance with an advantageous feature of the present invention, the drive member is driven on parallel portions of a travel path of two guide rollers arranged spaced apart in the direction of movement of the pushing device, and the drive member is mounted so as to be movable back and forth transversely of the direction of movement of the pushing device in a hollow space of the pushing device provided with walls which are connected so as to be drivable together. This makes it possible to use simple drive elements.

In accordance with an advantageous feature, the travel path of the drive member is determined by the length of the transfer path which is at least equal to the length of the parallel portions of the travel path.

It is advantageous if the hollow space receiving the drive member has in the transverse direction thereof at least the width of the travel path of the drive member in the area of a guide roller, so that the configuration is low in wear and damps noise.

In accordance with another advantageous feature, the hollow space has two walls located opposite each other and especially resting against the drive member at the parallel portions of the travel path, wherein the drive member moves at the walls in the deflection area of the guide rollers transversely of the direction of movement of the pushing device.

The drive unit is advantageously placed underneath the pushing device, so that a compact construction is achieved and the components thereof are easily accessible.

The pushing device is preferably divided into an area for the collecting container and an area following in the direction of movement and provided for the guiding arrangement or the drive unit, so that a favorable construction and a separation of the individual movement components can be achieved.

In accordance-with an advantageous feature, the collecting container area is arranged as seen in the transfer direction behind the area of the pushing device provided for the guide arrangement or the drive unit, so that an optimum drive concept between the pick-up position and the collecting point can be achieved.

In accordance with a recommended feature, the guide roller of the traction means connected to a motor is arranged between the pick-up position and the collecting point of a collecting container, so that a space-saving but easily accessible arrangement is achieved.

If the pick-up position of the collecting containers is formed by a conveying device for empty collecting containers, it is advantageous if the rearward portion of the pushing device as seen in the transfer direction extends in the initial position into the pick-up position of the collecting containers. If the hollow space constructed as a slot extends perpendicularly of the movement of the pushing device, the speed of the pushing device is increasingly decelerated when the drive member enters the curved path portion formed by the guide roller and is once again increasingly accelerated at the turning point of the curved path portion until the parallel portions of the traction means are reached.

For continuously changing the movement of the pushing device at the deceleration and/or the acceleration end of the transfer path, the guide slot could also be cam-shaped, especially since when filled containers are ejected from the collecting point, a harmful impact of the front edge of the pushing device at the collecting container should be avoided.

If a transversely extending straight guide slot is used, it is because of the running of a motor only possible with appropriate additional technical means (positioning drive or servo drive) to stop the pushing device in a specific position.

As an alternative to the straight or curved guide slot, the hollow space can also be constructed in such a way that for driving the pushing device the drive member is first in contact with a wall arranged transversely of the direction of movement of the pushing device, the drive member then changes its position along the wall and transversely of the direction of movement of the pushing device when traveling around a guide roller, and the drive speed of the pushing device is decelerated in the selected direction at the turning point of the guide roller until zero. From the turning point the wall extends approximately at 90° and concentrically relative to the axis of rotation of the guide roller and ends with a portion extending parallel to the direction of movement at the wall which continues transversely of the direction of movement of the pushing device and is constructed as a stop. When the drive member travels around the opposite guide roller, the guide member changes its position at this wall as already-described above.

The hollow space is composed geometrically of two geometric surfaces of equal size which are located diametrically opposite each other at an axis extending transversely of the direction of movement of the pushing device, wherein the geometric surfaces are formed of a square and an adjacent quarter circle and can be compared to an eye which is inclined by about 45° and whose pupil is formed by a central guide pin which in the quarter circle area defines together with the wall of the hollow space a guide path.

The drive member fastened to the traction means preferably is composed of a preferably cylindrical drive part protruding into the hollow space and a fastening part connected to the endless traction means, wherein the traction means extends in the axis of the cylindrical drive part, so that a direct drive transmission from the traction means to the pushing device is created.

The drive member is fastened to the traction means by forming a loop of the traction means through which a mandrel extends and which is connected to the fastening part of the drive member, so that the traction means is not weakened.

The loop of the traction means is advantageously anchored in an annular gap formed by the mandrel and above the drive part, so that a reliable drive connection can be achieved.

A support member guided on the transfer path is provided between the drive part and the fastening part, so that a rotation of the traction means between the guide rollers can have no influence on the position of the drive part in the hollow space.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
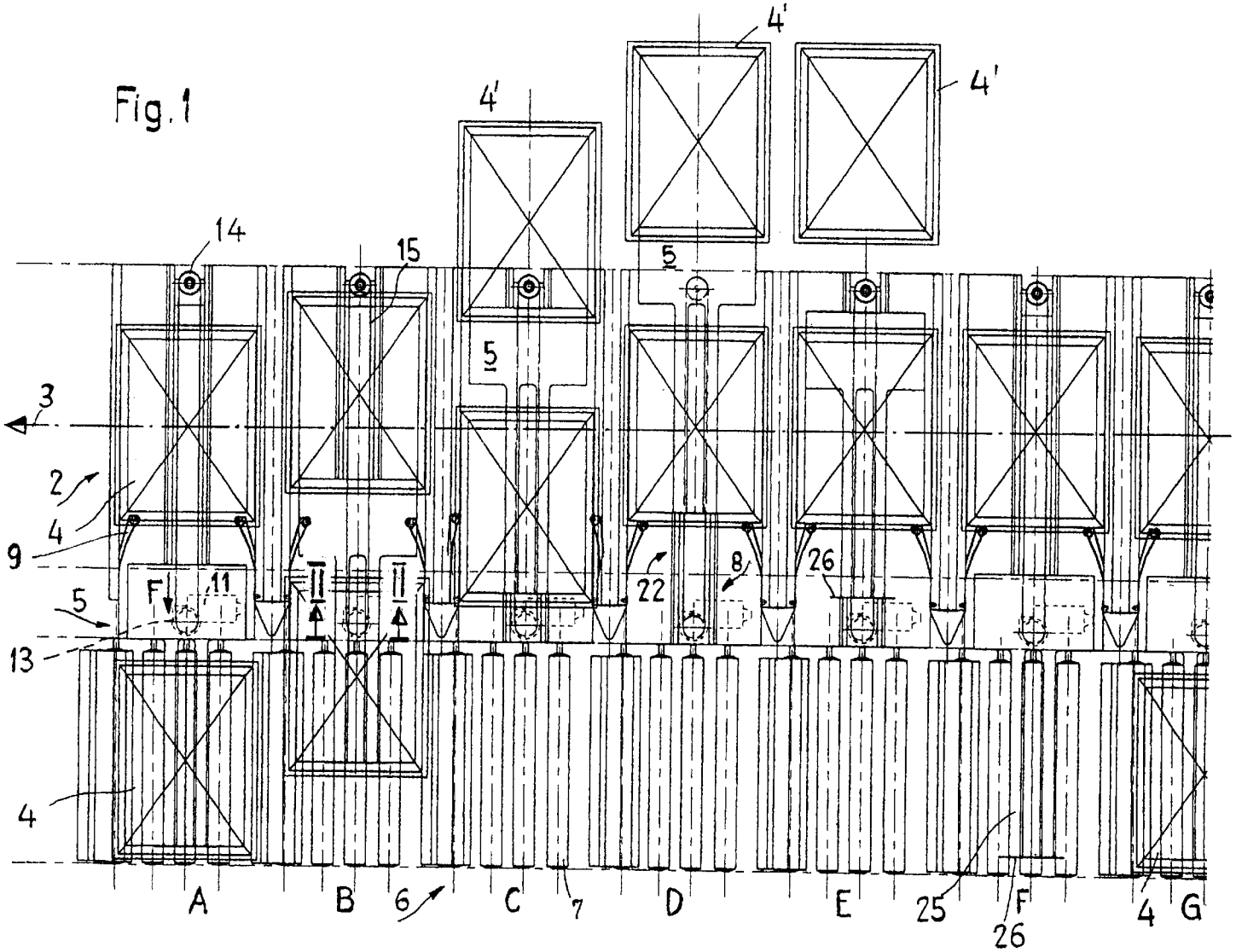
FIG. 1 is a top view of a portion of a sorting device for selectively collecting flat products.

FIG. 1 is a partial illustration of a collecting area of a sorting device 1 for flat products, particularly shipping pouches, printed products or workpieces, which are supplied to collecting points 2 by means of a revolving conveyor 3 indicated by dash-dot lines above a collecting area formed by several collecting points 2. Such a conveyor is described, for example, in EP-A-0 638 501.

Empty collecting containers 4 are waiting at the collecting points 2 for receiving the products, wherein products determined for a certain shipping location are dropped into each container. Once the capacity of a collecting container 4 is reached, this full container 4 is replaced by an empty container; as described, for example, in EP-A-0 899 026, the full collecting container 4 is pushed by a pushing device 5 which supplies an empty container 4 from the side from the collecting point 2 onto a conveyor belt or similar conveying means.

The exchange procedure of a collecting container 4 will now be explained step by step in connection with the collecting points 2 shown in FIG. 1 in a row along the conveyor 3.

The conveying direction of the conveyor 3 is indicated by an arrow in dash-dot lines. The illustrated collecting area has a pick-up position 6 for the collecting containers 4 assigned to the collecting points 2 which may also be placed manually onto the pushing device 5. The pick-up position 6 on the side of the collecting points 2 is formed by drivable rollers 7 which make it possible to ensure that empty collecting containers 4 are made available without gaps along the collecting area, i.e., so that each collecting point 2 is provided with an empty container 4.

The conveying direction of the pick-up position can be in the same direction or the opposite direction of the conveying direction of the conveyor 3. In the position A, the pushing device 5, which will be described in more detail below, is in its initial position in which the collecting point 2 is occupied by a collecting container 4 underneath the conveyor 3.

In the initial position of the pushing device 5, this pushing device 5 forms in the receiving area of the collecting container 4 approximately a plane with the upper sides of the rollers 7.

The collecting points 2 are constructed as points for depositing the collecting containers 4 to which products are to be supplied, wherein the pushing device 5 which moves the empty collecting container 4 into the collecting point 2 is pulled when moving back into its initial position underneath the collecting container 4 which rests with its rearward wall as seen in the feeding direction against a swung-in holding-back device 9.

In position B, the pushing device 5 supporting the collecting container 4 has left the initial position at the pick-up position 6 with an empty collecting container 4 and simultaneously pushes with its forward end the full collecting container 4 out of the collecting point 2. To prevent damage to the collecting containers 4', the pushing device 5 which pushes out the full collecting containers 4' is constructed at its pushing forward edge with a large surface area.

In position C, the holding-back device 9 is pushed to the side by the empty collecting container 4.

In position D, the empty collecting container 4 and the filled collecting container 4' have reached the collecting point 2 for the location for being transported on a conveyor belt, respectively. The holding-back device 9 is once again swung behind the empty collecting container 4 in the collecting point 2.

Position E shows the pushing device in its return movement during which the empty collecting container 4 placed in the collecting point 2 rests with the rear side against the back-holding device 9.

The back-holding position corresponds to the collecting position of the collecting container 4.

In position F, the pushing device 5 has once again reached the initial position and extends into the pick-up position 6 where a collecting container 4 under which the pushing device 5 has traveled waits for the pushing device or where the pushing device is filled with a collecting container 4 from the pick-up position 6.

Figure 2:
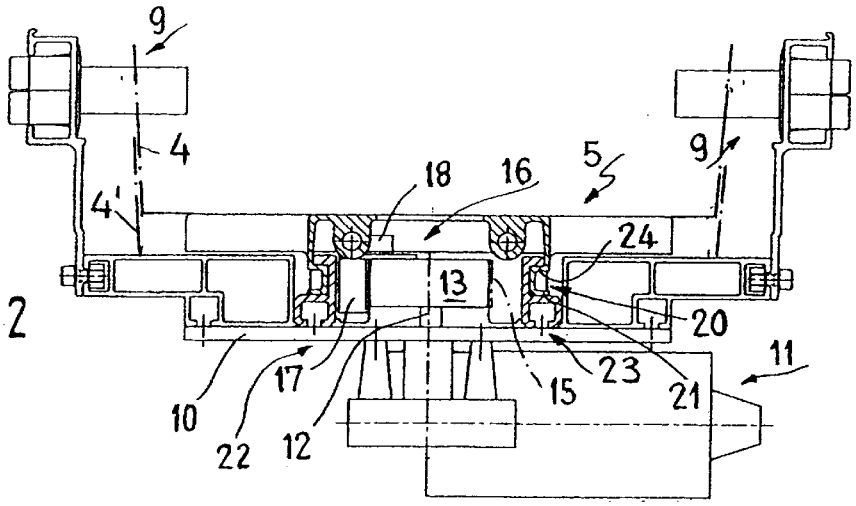
FIG. 2 is a sectional view of the pushing device of a sorting device taken along sectional line II—II in FIG. 1.
Figure 3:
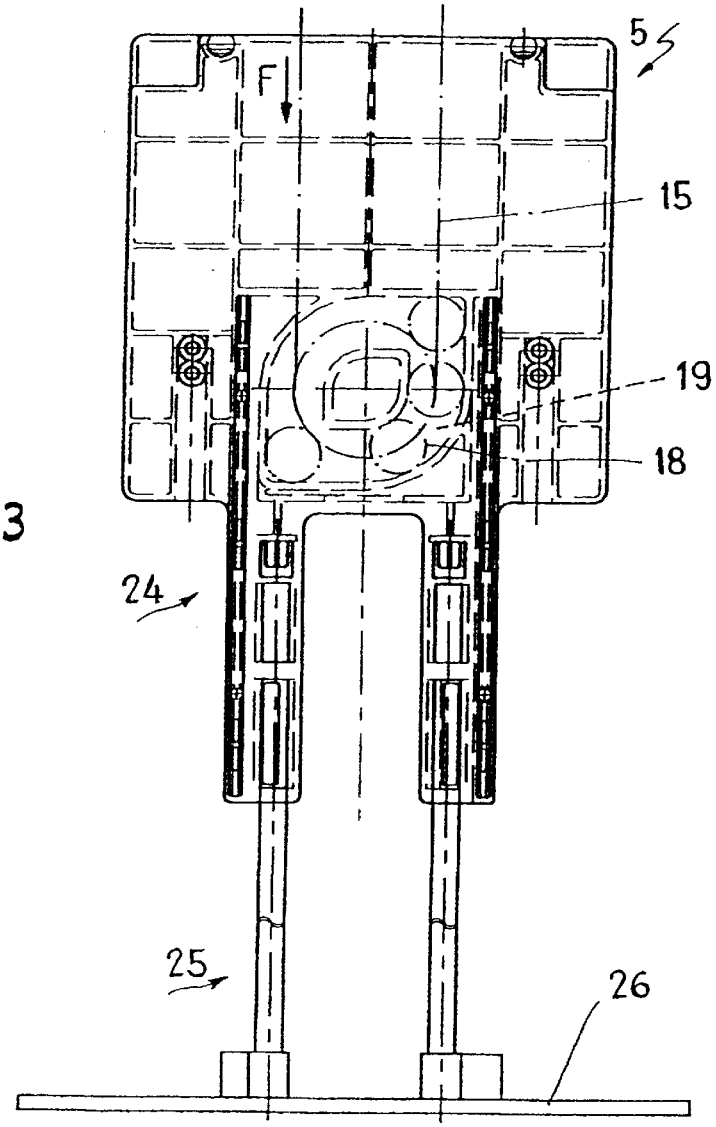
FIG. 3 is a top view of the pushing device for a sorting device.

FIG. 2 of the drawing is a cross-sectional view of the pushing device 5 and the corresponding guide arrangement 22 and FIG. 3 is a top view of the pushing device 5.

A controllable gear motor 11 is screwed onto a support plate 10 which is fixedly connected to the sorting device 1. A driven guide roller 13 is fastened to the perpendicularly extending drive shaft 12 which extends through the support plate 10. The guide roller 13 drives together with a guide roller 14 spaced apart in the direction of movement of the pushing device 5 an endless traction means 15, for example, flat belts or toothed belts; in the direction of arrow F in FIG. 1. An outwardly protruding drive member 16 is attached to the traction means 15. The drive member 16 is connected with a fastening part 17 to the traction means 15 and protrudes with a drive part 18 into a hollow space 19 provided in the pushing device 5 and formed by connected wall portions.

The wall portions of the hollow space 19 interact with the drive part 18 of the drive member 16 attached to the traction means 15 in a conveying and controlling manner, so that the pushing device 5 reverses its direction of movement when reaching the conveying end at the transfer path of the collecting containers 4 from the initial position into the collecting position 2 determined by the spacing between the guide rollers 13, 14.

Provided for moving the pushing device 5 from the initial position into the collecting point 2 and back is a guide arrangement 22 formed of a guide groove 20 and a guide ledge 21 on both sides of the endless traction means 15, wherein the guide groove 20 is arranged in a profiled ledge 23 attached to the support plate 10 and the guide ledge 24 moved in the guide groove 20 is arranged on the pushing device 5.

The pushing device 5 is of flat construction and is of a material which is wear-resistant and provides stability, for example, synthetic material.

The drive unit 8 composed of gear motor 11, guide rollers 13, 14, traction means 15 and drive member 16 is arranged underneath the pushing device 5, so that a compact and low structural configuration is achieved.

Because of its flat construction, the pushing device 5 is provided with a plurality of ribs, as shown in the drawing.

In the embodiment illustrated in FIG. 3, the pushing device 5 is constructed of several parts for manufacturing reasons. An embodiment composed of one piece, as seen in FIG. 1, cannot be manufactured with accurate dimensions with an injection molding process. Moreover, as is apparent from the slidable extension 25 shown in FIG. 3, the embodiment composed of several parts permits an adjustment of the length of the pushing device 5 to different container dimensions, particularly the container length. The pushing device 5 is rectangular plate-shaped and constructed at its front end face for ejecting the full collecting containers 4' from the collecting point 2, and the pushing device 5 has on its bottom side, rearwardly offset from the front end face, the hollow space 19 for the drive part 18 of the drive member 16 which travels on the traction means 15 around the guide rollers 13, 14.

FIG. 3 shows an alternative configuration of the hollow space 19 and the different positions of the drive part 18 in the hollow space 19 while the drive member 16 is traveling.

Adjacent to the hollow space 19, the pushing device 5 is formed by an insertable extension 25 which is required for placing an empty collecting container 4. The complete length of the pushing device 5 can be seen in FIG. 1. FIG. 1 also shows the two cantilever-like extensions 25 which can be moved between the rollers 7 of the pick-up position 6 and are provided at the rearward end thereof with a stop 26 for moving the collecting containers 4.

The length of the transfer path is determined by the distance between the guide rollers 13, 14 or the diameters thereof and by the configuration of the hollow space 18.

The guide roller 13 of the traction means 15 of the pushing device 5 driven by a gear motor 11 is located between the pick-up position of a collecting container 4 placed on the rollers 7 and the collecting point 2 to which the collecting containers 4 with products are fed.

In the initial position of a collecting container 4, illustrated at position A, the rearward portion of the pushing device as seen in the transfer direction extends by means of the extension 25 into the pick-up position of an empty collecting container 4.

Figure 4:
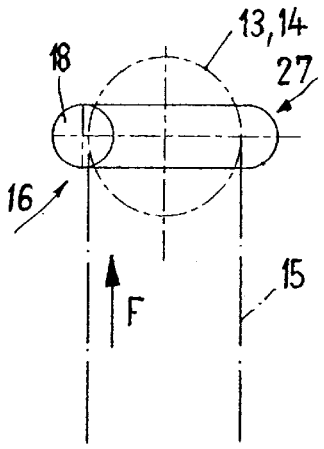
FIGS. 4, 4.1 and 4.2 are schematic illustrations of a drive member in a guide slot.
Figure 4:
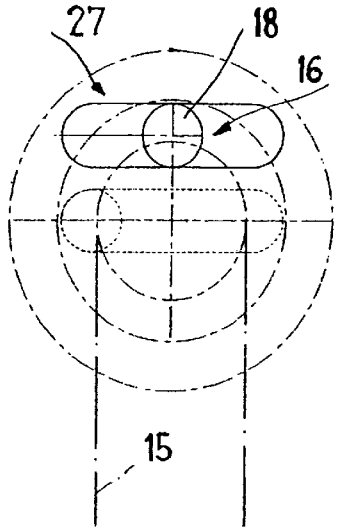
Figure 4:
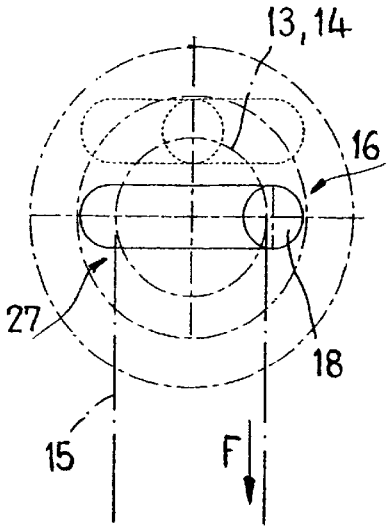

The configuration of a hollow space 19 for the drive part 18 of the drive member 16 may be, for example, slot-shaped. FIG. 4 shows a guide slot 27 extending transversely of the direction of movement of the pushing device forming the hollow space 19 and FIG. 4 shows the guide roller 14 of the traction means 15. As soon as the drive member 16 connected to the pushing device 5 arrives at the circumference of the guide roller 14, the subsequent quarter circle at the guide roller 14 causes an increasing deceleration of the speed of movement of the pushing device 5 to zero, and the immediately adjacent quarter circle of the guide roller 14 then causes an increasing acceleration. This travel of the guide member 16 at the guide roller 14 and in the guide slot 27 of the pushing device 5 is illustrated in FIGS. 4, 4.1 and 4.2.

The drive member 16 fastened to the traction means 15 drives the pushing device 5 by means of the drive part 18 which extends into the transversely arranged guide slot 27. Following the position illustrated in FIG. 4, the drive part 18 travels on the quarter circle arch of the guide roller within the guide slot 27 by half the distance of its movement to the turning point at the guide roller and leaves this location by another half distance in the same direction. As this occurs, the pushing device 5 is increasingly accelerated into the opposite direction, wherein starting with the turning point at the guide roller 14 the drive part 18 has made contact with the opposite wall, as seen in FIG. 4.2.

The same sequence occurs in the opposite direction at the opposite guide roller. A control means ensures that the pushing device 5 stands still or is stopped in the initial position until the next exchange of a collecting container 4 takes place. Because of the guide slot 27, an accurate stopping of the pushing device 5, which is connected to a freewheeling or uncontrolled, inexpensive motor, is not simple.

Figure 5:
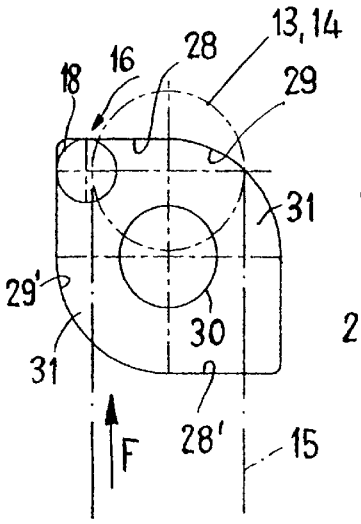
FIGS. 5, 5.1 and 5.2 are schematic illustrations of another embodiment of the hollow space and the positions of the drive member.
Figure 5:
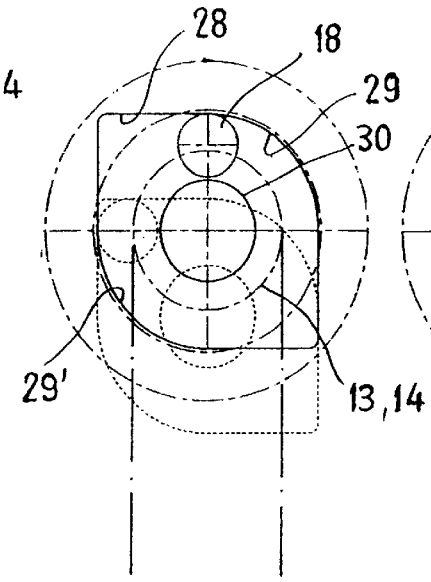
Figure 5:
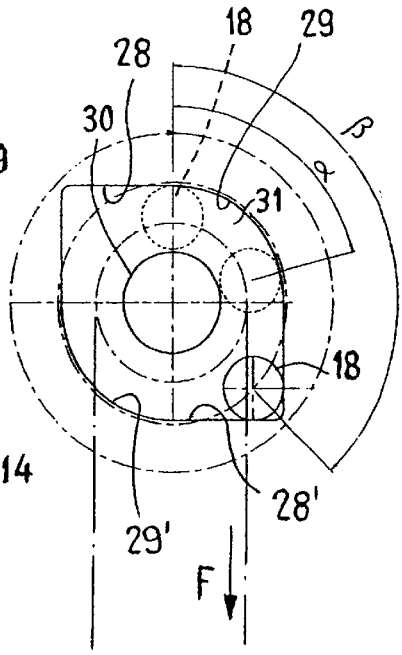

This disadvantage can be eliminated by using instead of a guide slot 24 a hollow space 19 as shown in FIG. 3. Such a hollow space 19 is shown in more detail in FIGS. 5, 5.1 and 5.2. The wall portions 28, 28' intended for driving the pushing device 5 and once again arranged transversely of the direction of movement of the pushing device 5, are located opposite each other diametrically of a parallel plane extending transversely of the direction of movement of the pushing device 5; the wall portions 28, 28' are extended by a circular arc-shaped wall portion 29, 29' which stops the pushing device at the respective ends of the transfer path, wherein the wall portion 29, 29' forms together with a centrally arranged cylindrical raised portion 30 a guide path 31 of the drive member 16 or the drive part 18. FIG. 5.2 shows the situation in which the guide member 16 or guide part 18 travels after the turning point on a guide path 31 and subsequently reaches the diametrically oppositely arranged wall portion 28'.

Along the angle portion α of the guide path 31 which is less than 90° because of the necessary guide play, the pushing device 5 is held in a stopped position by the drive part 18 and remains in this position or in the collecting point 2 until the drive part 18 makes contact with the wall portion 28'. This results for the guide roller 14 from the turning point to the wall portion 28' in a rotary movement of about 135° which can be used as the run-out play of the gear motor 11, wherein this run-out play is utilized particularly for the longer stay of the pushing device 5 in the initial position, i.e., in the pick-up position 6 of the collecting containers 4.

Figure 7:
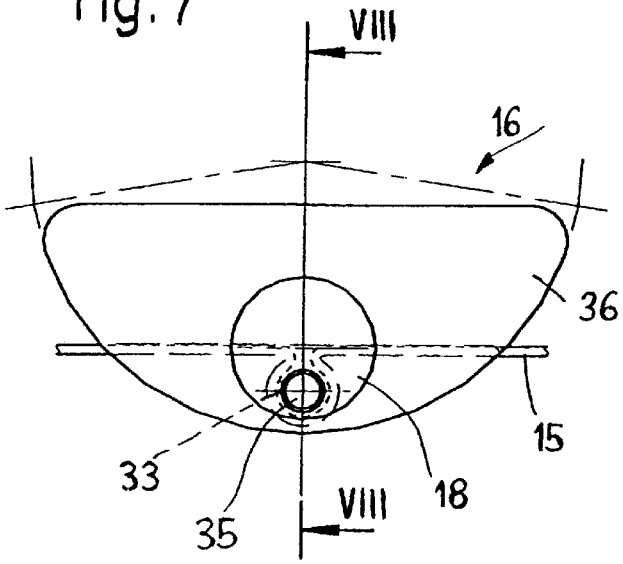
FIG. 7 is a side view of the drive member of FIG. 6.
Figure 6:
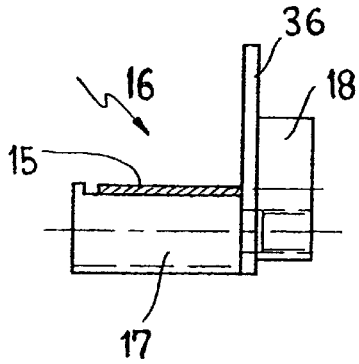
FIG. 6 is a top view of a drive member.
Figure 8:
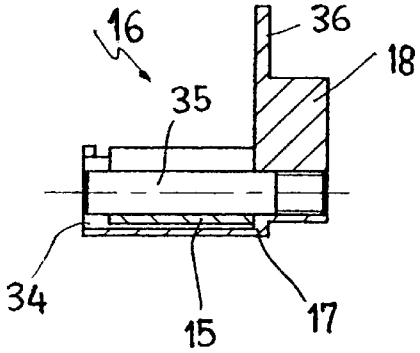
FIG. 8 is a sectional view of the drive member taken along sectional line VIII—VIII in FIG. 7.

As already mentioned, the drive member 16 is composed of a drive part 18 which extends into the hollow space 19 of the pushing device 5 and the fastening part 17 connected to the endless traction means 15 in the form of a flat belt or toothed belt, as seen in FIGS. 6 to 8.

FIG. 7 shows the type of fastening of the drive member 16 to the traction means 15, wherein a loop 33 formed of the traction means 15 surrounds a threaded bolt 35 or mandrel in a cylindrical chamber 34 of the fastening part 17, as also shown in FIG. 8. The drive member 16 has between the drive part 18 and the fastening part 17 a support member 36 which serves to hold and guide the traction means 15, particularly along the straight portions where the support member 36 is guided along a ledge, not shown.

For effecting the exchange of the collecting containers 4, 4' at the collecting point 2, the collecting point 2 could be provided with a device for measuring the degree of filling which is connected to a control for triggering a signal when a collecting container 4, 4' must be exchanged.

The invention is not limited by the embodiments described above which are presented as examples only but can be modified in various ways within the scope of protection defined by the appended patent claims.

We claim:

1. A device for sorting and selectively collecting flat products, the device comprising means for placing the flat products at predetermined collecting points along a conveying path of an endless conveyor and below the conveyor in collecting containers, and a pushing device for moving empty collecting containers transversely of a direction of movement of the conveyor on a transfer path between a lateral pick-up position and a collecting point, wherein the pushing device is mounted so as to be reversibly driven in a guide arrangement of the transfer path, further comprising means for ejecting filled collecting containers from the collecting point, wherein, for driving the pushing device, the pushing device is connected to a drive member of a fixedly mounted drive unit, and wherein the drive member is attached to an endless traction means.

2. The device according to claim 1, wherein the drive member is mounted so as to be driven on parallel portions of a travel path of two guide rollers arranged spaced apart in a direction of movement of the pushing device, and wherein the drive member is mounted so as to be movable back and forth transversely of the direction of movement of the pushing device in a hollow space of the pushing device provided with walls which are connected so as to be drivable together.

3. The device according to claim 2, wherein a length of the transfer path is at least equal to an effective length of the parallel portions of the travel path of the drive member.

4. The device according to claim 2, wherein the hollow space has in a transverse direction thereof at least a width equal to the width of the travel path of the drive member in an area of the guide roller.

5. The device according to claim 2, wherein the hollow space has two oppositely located wall portions configured to contact the drive member along the parallel portions of the travel path.

6. The device according to claim 1, wherein the drive unit is mounted below the pushing device.

7. The device according to claim 1, wherein the pushing device has a collecting container portion and a second portion for the drive arrangement, wherein the second portion is arranged following the collecting container portion in the travel direction.

8. The device according to claim 7, wherein the collecting container portion is mounted in the transfer direction behind the second portion.

9. The device according to claim 2, wherein one of the guide rollers of the traction means is connected to a motor, wherein the guide roller connected to the motor is mounted between the pick-up position and the collecting point of a collecting container.

10. The device according to claim 7, wherein a rearward portion of the pushing device in the transfer direction extends in an initial position into the pick-up position of a collecting container.

11. The device according to claim 5, wherein the wall portions of the hollow space form a guide slot extending transversely of the direction of movement of the pushing device.

12. The device according to claim 5, wherein the wall portions of the hollow space for contacting the guide member and extending transversely of the direction of movement of the pushing device are arranged diametrically opposite a parallel plane extending transversely of the direction of movement of the pushing device, and wherein the wall portions have circular arch-shaped extension wall portions for holding the pushing device in a position of rest at an end of the transfer path, wherein the extension wall portion together with a central raised portion form a guide path for the drive member.

13. The device according to claim 12, wherein the extension wall portion is connected to a wall portion extending parallel to the direction of movement of the pushing device and forming a closed wall.

14. The device according to claim 5, wherein the drive member comprises a cylindrical drive part protruding into the hollow space and a fastening part connected to the traction means, wherein the traction means extends at least approximately in an axis of the drive part.

15. The device according to claim 14, wherein the traction means is connected by a loop and a mandrel extending through the loop to the fastening part of the drive member.

16. The device according to claim 15, wherein the loop of the traction means is mounted in an annular gap in the fastening part of the drive member.

17. The device according to claim 14, wherein the drive member has a support device between the drive part and the fastening part.

18. The device according to claim 1, comprising means for adjusting an effective length of the pushing device in the direction of movement thereof.

* * * * *